US007640860B1

(12) United States Patent
Glover et al.

(10) Patent No.: US 7,640,860 B1
(45) Date of Patent: Jan. 5, 2010

(54) CONTROLLED ENERGY RELEASE PROJECTILE

(76) Inventors: Charles H. Glover, 4845 Calico Rd., Lenoir, NC (US) 28645; Susan O. Hartley, 4845 Calico Rd., Lenoir, NC (US) 28645

( * ) Notice: Subject to any disclaimer, the term of this patent is extended or adjusted under 35 U.S.C. 154(b) by 381 days.

(21) Appl. No.: 11/139,660

(22) Filed: May 31, 2005

Related U.S. Application Data

(63) Continuation-in-part of application No. 09/721,062, filed on Nov. 22, 2000, now Pat. No. 6,899,034, which is a continuation-in-part of application No. 09/107,892, filed on Jun. 30, 1998, now abandoned.

(51) Int. Cl.
*F42B 7/00* (2006.01)
*F42B 7/04* (2006.01)

(52) U.S. Cl. ..... 102/457; 102/456; 102/506; 102/501

(58) Field of Classification Search ..... 102/457, 102/438, 439, 448–463, 501, 502, 506, 517, 102/520, 532
See application file for complete search history.

(56) References Cited

U.S. PATENT DOCUMENTS

| | | | | |
|---|---|---|---|---|
| 1,941,336 | A * | 12/1933 | Barbieri | 102/457 |
| 3,911,820 | A * | 10/1975 | Canon | 102/438 |
| 4,471,699 | A * | 9/1984 | Turco et al. | 102/501 |
| 4,913,054 | A * | 4/1990 | Petersen | 102/439 |
| 5,293,822 | A * | 3/1994 | Peddie | 102/506 |
| 5,596,167 | A * | 1/1997 | Davis | 102/532 |
| 6,067,909 | A * | 5/2000 | Knoster, Jr. | 102/517 |
| 6,257,147 | B1 * | 7/2001 | Davies | 102/439 |

* cited by examiner

*Primary Examiner*—James S Bergin

(57) ABSTRACT

A projectile is provided, in accordance with the present invention that includes a gas seal, an absorption zone, a core material containment area, a mass of material within the containment area and an actuator member. The containment area is characterized by the ability to peel back upon itself on impact, thereby releasing the mass of core particles after impact. The actuator, is releasably fixed to the hull open end, and has a stem member that projecting into the mass of material. Prior to initial impact the actuator maintains the core material within the containment area hull and, up initial impact, the actuator is continues to be propelled forward, along with the core material.

28 Claims, 10 Drawing Sheets

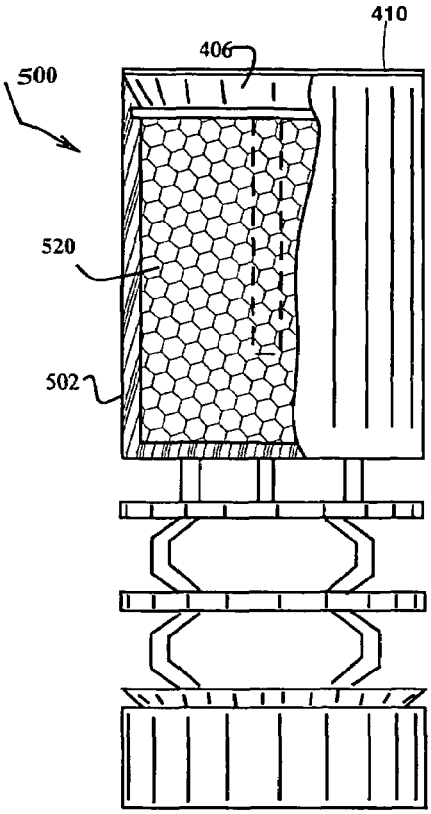
Figure 7
Figure 5
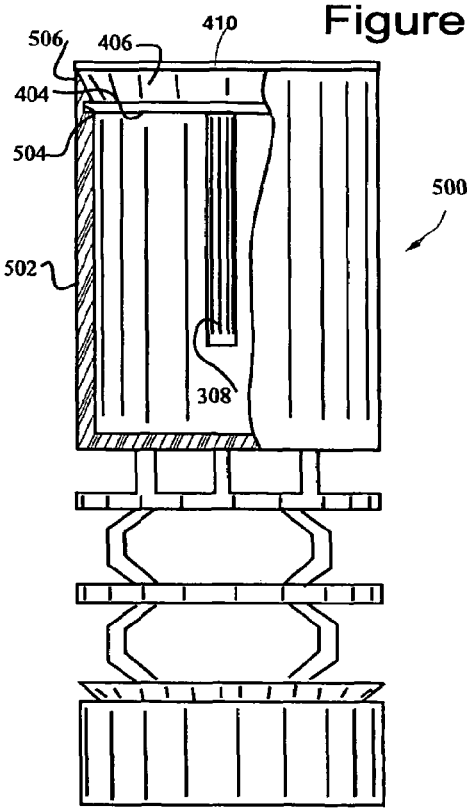
Figure 6
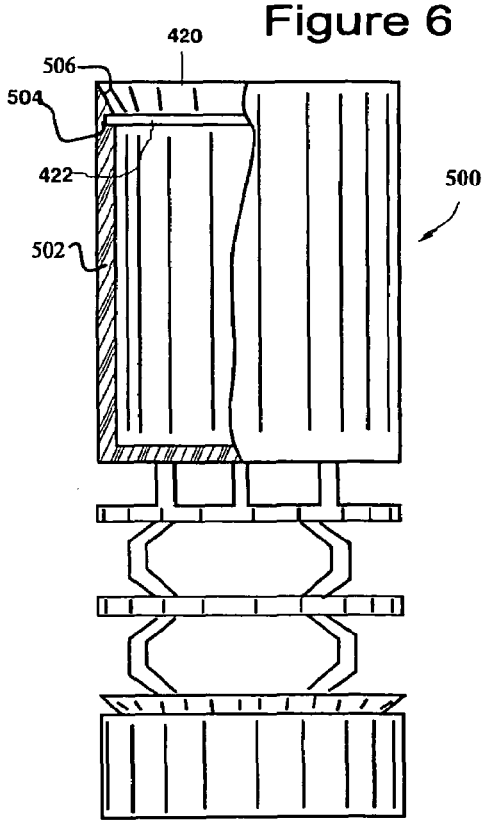

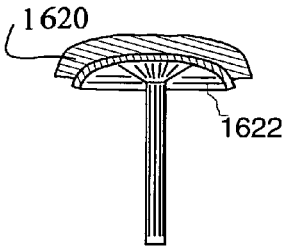
Figure 22
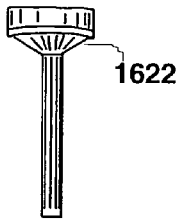
Figure 23
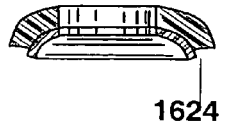
Figure 24
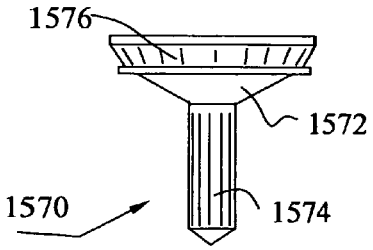
Figure 17
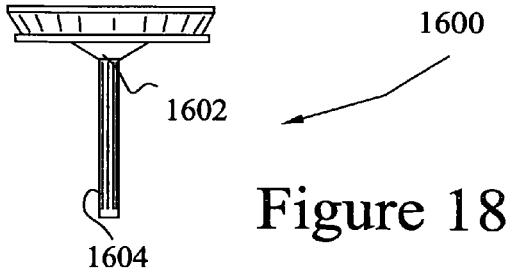
Figure 18
Figure 16
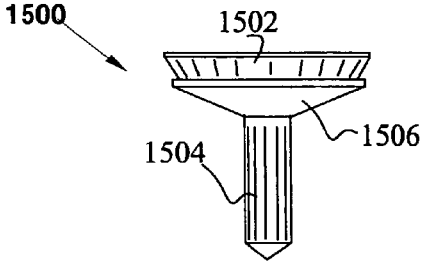
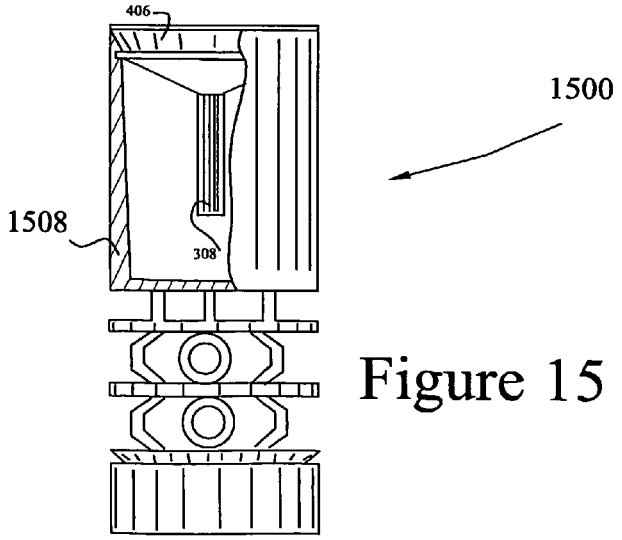
Figure 15

CONTROLLED ENERGY RELEASE PROJECTILE

CROSS-REFERENCE TO RELATED APPLICATIONS

This application makes reference to the following U.S. patent applications. The first application is U.S. application Ser. No. 09/107,892, entitled "Polymer Jacketed Fragmentation Type Projectile for Smooth Bore Guns," filed Jun. 30, 1998, now abandoned. The second application is U.S. application Ser. No. 09/721,062, entitled "CONTROLLED ENERGY RELEASE PROJECTILE," filed Nov. 22, 2000 and issued as U.S. Pat. No. 6,899,034, issued May 31, 2005. The entire disclosure and contents of the above applications are hereby incorporated by reference.

GOVERNMENT INTEREST STATEMENT

The United States Government has no rights in this invention.

BACKGROUND

1. Field of the Invention

The present invention relates to a fragmentation type projectile for antipersonnel use, and more particularly, to a fragmentation type projectile having increased stopping power and after initially hitting a target, having a decreased lethal range.

2. Related Art

The problems associated with ammunition missing, or going through the target, and hitting an innocent bystander has long been acknowledged. Various methods of resolving the problem have been approached; however, none have eliminated the inadvertent injuries and deaths.

Various forms of smooth bore shotgun projectiles, specifically buckshot and slugs, originally designed for use in hunting big, and/or dangerous game animals, are well known in the art. Although these designs are the most common types of shotgun ammunition used by the law enforcement community, their excessive destructive capabilities have always presented liability problems in law enforcement situations.

These projectiles are designed for deep penetration in game animals weighing up to one thousand pounds. With only a fractional loss of energy, they will completely penetrate a human sized target. The small percentage of energy transference to the target makes these hunting projectiles very inefficient and dangerous for use in crowded urban environments. Both slugs and larger sizes of buckshot are capable of passing through multiple residential type interior walls, and/or non-masonry exterior walls, while retaining lethal energy.

Shotgun projectiles have been designed typically to have either a single projectile, or core element (slug), or multiple projectiles, or core elements (shot or pellets). In the multiple projectile, or core element design, a shot cup or core material containment area protects the projectiles from deformation inside the shotgun barrel and upon exit from the barrel separates from the core elements prior to impact.

Typically, this shot cup or core material containment area is slit and peels back during flight, due to wind resistance. The pellets then travel in a progressively spreading pattern and impact a target as a collection of individual particles whose impact area is dependent upon the distance the pellets have traveled.

A target struck by small, less dangerous multiple individual pellets receives very little post impact trauma or blunt trauma injury, as the individual pellets displace minimal kinetic energy, which is lost rapidly during flight or upon the first impact. By way of contrast, a slug and to a lesser extend large buck shot, generally hits with enough kinetic energy and penetration to produce blunt trauma injury, over penetration of an initial target and lethality for an extended period of travel beyond. The difficult problem of achieving a balance between the safer, small and inefficient individual pellet impact and the dangerous, but effective slug impact, is not only achieved by the process and projectile of the present invention, but is achieved in a controlled manner.

The disclosed unique type of projectile will penetrate an initial barrier, create a secondary incapacitation zone of several feet or greater if so desired, and then become non-lethal down range. It is through a controlled expansion process that the present ammunition achieves a result that is different from any ammunition ever designed.

SUMMARY

BRIEF DESCRIPTION OF THE DRAWINGS

The invention will be described in conjunction with the accompanying drawings, in which:

FIG. 5 is a side elevation view, partly in section, of a further embodiment of a projectile in accordance with the present invention shown with the actuator of FIG. 4 positioned within the core material containment area;

FIG. 6 is a side elevation view, partly in section, of an additional embodiment of the invention;

FIG. 7 is a side elevation view, partly in section, of the embodiment of FIG. 5, shown with the actuator of FIG. 4 and core particles positioned within the core material containment area;

FIG. 15 is a partial cut away view of a core material containment area embodiment having tapered walls;

FIG. 16 is a side view of an actuator in accordance with the disclosed invention;

FIG. 17 is a side view of another actuator embodiment with the cone having a smaller angle;

FIG. 18 is a side view of an alternative actuator embodiment having a small angled cone;

FIG. 22 illustrates the actuator of FIG. 18 undergoing failure caused by too soft of a material of manufacture and too narrow of a stem;

FIG. 23 is a side view of the actuator of FIG. 22 after separation of the actuator ring;

FIG. 24 is a side view of the separated actuator ring;

DETAILED DESCRIPTION

Figure 1:
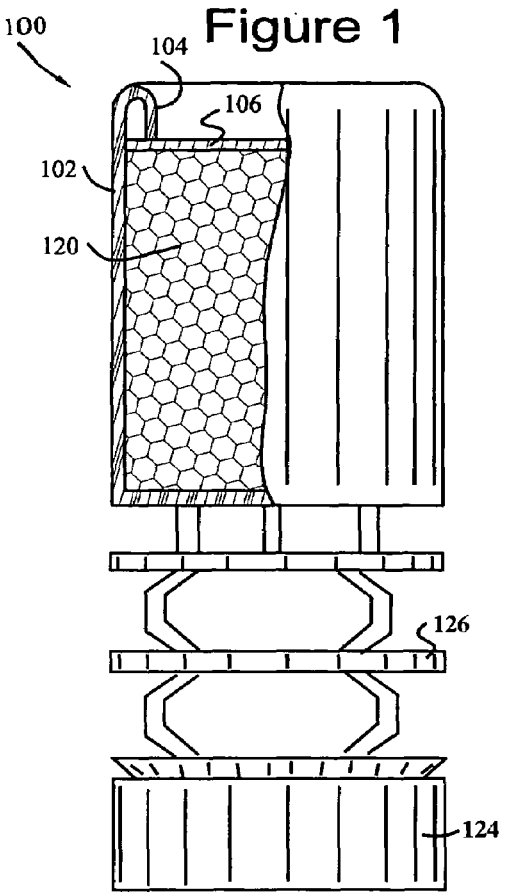
FIG. 1 is a side elevation view, partly in section, of a projectile in accordance with the present invention.

It is advantageous to define several terms before describing the invention. It should be appreciated that the following definitions are used throughout this application.

DEFINITIONS

Where the definition of terms departs from the commonly used meaning of the term, applicants intend to utilize the definitions provided below, unless specifically indicated.

For the purposes of the present invention, the term "actuator" refers to any device that will initiate a real timed expansion of core material upon initial impact.

For the purposes of the present invention, the term "contact time expansion" refers to the expansion time of prior projectiles wherein expansion only takes place while the projectile is experiencing a high level of resistance while traveling through a dense or viscous medium.

For the purpose of the present invention, the term "controlled expansion" refers to predetermining the expansion time of the core material by actuator design.

For the purpose of the present invention the term "controlled peel back rate" refers to a rate of peel back that is substantially equal to the velocity of the projectile.

For the purposes of the present invention, the term "core material" refers to a mass of material, including but not limited to lead, tungsten, steel, carbide, and/or plastic compounds in small rigid, or semi rigid, particles or plates;

For the purposes of the present invention, the term "core material containment area" or "core material containment member" refers to the cylindrical body of the projectile that encapsulates the core material. The terms are used interchangeable within the application and have equal meaning unless otherwise noted.

For the purposes of the present invention, the term "first lethal distance" refers the distance from the firing of the projectile to initial impact For the purposes of the present invention, the term "initial impact" refers to the first obstacle encountered by a projectile.

For the purposes of the present invention, the term "lethal" refers to impact force that is sufficient to cause death of a person or destruction of an inanimate object.

For the purposes of the present invention, the term "lethal mass" refers to a body of core material that has sufficient energy to cause death of a person or destruction of an inanimate object.

For the purposes of the present invention, the term "obstacle" refers to any object that will cause the core material containment area to peel back.

For the purposes of the present invention the term "particles" refers to small pellets manufactured from any dense, rigid or semi-rigid material, including but not limited to lead, silicon carbide or plastics.

For the purposes of the present invention the term "peel back" refers to the leading end of the projectile core material containment area opening and peeling back so that the exterior surface of the leading end lies adjacent to at least part of the exterior surface of the trailing end.

For the purposes of the present invention the term "peel back rate" refers to the time it takes for the projectile core material containment area to peel back and expose the core material.

For the purposes of the present invention the term "pressure or shock wave" refers to the series of air waves that form in front of a supersonic or subsonic projectile and can produce sudden large changes in pressure.

For the purposes of the present invention, the term "projectile body" refers to the exterior covering that covers the entire projectile.

For the purposes of the present invention, the term "real time expansion" is refers to the time sequence of events, unique to this projectile design, that take place upon impact wherein once the expansion process is initiated it continues through to completion at a controlled rate regardless of the circumstances or resistance.

For the purposes of the present invention, the term "second lethal distance" refers to the distance from the initial impact to the point where the lethal mass becomes non-lethal.

For the purposes of the present invention, the term "third non-lethal distance" refers to the region where the distance traveled is such that the core material has become non-lethal.

DESCRIPTION

The law enforcement requirements for tactical ammunition are extremely specific and appear to be mutually exclusive. First, the ammunition must be capable of incapacitating an individual upon initial impact as quickly as possible. Second, it needs to do so with either a direct impact, or after passing through a barrier, such as a car windshield, a residential partition wall, or a residential door, used by the criminal as a shield. However, as a third requirement, it needs to pose as little threat as possible to innocent bystanders or people down range from the shooting position. For example, if a round is fired in an apartment building, the round must not endanger residents in neighboring apartments.

Conventional ammunition with a solid lead design, or with a solid lead core and a copper jacketing material, meets the first requirement reasonably well. This type of ammunition can be configured in an expanding design that will impart a fair amount of energy through the expansion process. This energy generally incapacitates the target upon impact. It meets the second requirement extremely well in that it only loses energy through contact resistance and can travel with lethal energy for hundreds of yards after an impact with something as non-resistant as a residential partition wall. The third requirement is where the conventional ammunition design fails, since it is designed to penetrate an initial barrier and retain lethal force beyond, there is a sacrifice of down range safety.

In an effort to create safer designs, ammunition designers have for many years experimented with "pre-fragmented" rounds that contained a plurality of sub-munitions inside a "hull", (typically a copper jacket similar to that on a conventional bullet). In the prior art the-design and operation of these rounds fall into one of two groups. The first is designed with loose particles inside the hull or jacket, and bursts into an uncontrolled spray of particles upon initial impact. The second type is comprised of loose particles that have been swaged into a solid mass, or bound together into a solid mass by some type of compound, such as epoxy. This second type of projectile is designed to penetrate solid obstacles, such as partition walls, and only break apart upon contact with a viscous media.

The first type of "pre-fragmented" round is much safer when deployed close to bystanders than conventional ammunition due to the fact that the round bursts into non-lethal particles upon the first impact. This type of round has never met with favor in police work because of its lack of effectiveness when the need arises to shoot through an initial barrier and disable someone on the other side.

The second type of "pre-fragmented" round is more effective in law enforcement scenarios but can be just as dangerous and prone to over penetration as conventional ammunition if it takes flight through a house, apartment or business complex.

The present invention provides for the unique combination of the full impact of a unitary structure while providing for radial dispersion of the impact energy. This is accomplished in three stages. The first stage is a forceful initial impact similar to that of a solid slug. The second stage is a short secondary zone, downstream of the point of initial impact, in which the projectile particles are lethal, but have slightly reduced penetration and a broader blunt trauma zone than that of standard tactical shot gun ammunition. In the third stage the particles have succumbed to air resistance and have become non-lethal or harmless.

The projectile converts upon an initial impact from (1) a unitary structure to (2) an expanding body of individual particles that continue to act as a unitary structure and (3) within a controlled distance, becomes a mass of discrete particles that rapidly lose their lethality. Stated another way, the projectile (1) initially acts like a slug, then (2) acts like a slug of substantially increased diameter and then (3) becomes a non-lethal object.

The increased diameter of the projectile after initial impact and during the lethal, formation of the core particles produces an impact comparable to that of a very high caliber projectile. The disclosed projectile, when the initial impact and expansion is within a body, produces a wide pressure or shock wave that can produce a lethal and immediately incapacitating impact upon organs. Incapacitation is critical in many tactical situations, as for example in interaction with armed aggressors where the need is to disable them immediately before they can react with deadly consequences.

In order to instantaneously incapacitate a terrorist it is essential that the projectile expand rapidly enough to completely decelerate within the internal organs, imparting all its energy without over penetration. The forward shock, or pressure, wave that is generated will impact the internal organs in advance of the projectile particles and a rebounding shock wave will impact the organs a second time. The rebounding pressure wave is the original wave reflected off of, and amplified by, the interior surface opposite the point of entry. The core particles will embed into the first surface, such as an organ or tissue, which has a density sufficient to stop their forward movement. This has been demonstrated by firing the projectile into a large plastic container of ballistic gelatin. The projectile blew apart the container without penetrating the rear of the container. The front of the container is considered to be the first side impacted by the projectile and the rear is the opposite side of the container. The zone of expansion from first impact to very low potential for lethality that is seven (7) to ten (10) feet, in free flight, is compressed to seven (7) to ten (10) inches in various viscous materials. In water, full projectile expansion and deceleration occurs within approximately four (4) inches of penetration, in ballistic gelatin approximately seven (7) inches, and in animal tissue and organs seven (7) to ten (10) inches.

A typical round of conventional ammunition can penetrate the body and produce little immediate incapacitation. By way of analogy, immediate incapacitation is more likely to be achieved by hitting the terrorist with a high velocity bowling ball rather than a high velocity spear. The spear can eventually produce death due to bleeding but would not prevent the terrorist from continuing to function for some limited period of time, perhaps as long as several hours. Conversely, the wide spread blunt trauma of the bowling ball impact would immediately stop the terrorist from continuing to function. If the terrorist is wearing a bulletproof vest, immobilization can only be achieved by impacting the terrorist with a huge amount of energy over a confined area.

As stated heretofore, the disclosed projectile can penetrate a first barrier and retain its lethal efficacy for a limited distance. The lethality after initial penetration must be such that the terrorist is immediately incapacitated by the blunt trauma impact of the expanding mass of core particles, even though the projectile had penetrated a protective barrier such as a wall or car windshield. However, in the event that the terrorist provides the first impact object, the projectile must become non-lethal upon penetration. The limitation of the distance should be such that the projectile will be incapacitating to an armed aggressor positioned directly behind a residential type partition wall, or door, but innocent parties who are at a significant distance from the wall or behind a second wall, would not be exposed to danger.

Law enforcement officers are sometimes killed by "friendly fire" when a fellow officer's projectile travels through an auto or partition wall, striking them on the other side with enough force to defeat their body armor. With the disclosed projectile design, after an initial impact the expanding projectile has increased blunt trauma potential but greatly reduced potential for penetration. In its expanding form it may still incapacitate but is much less likely to kill a person wearing body armor standing adjacent to the auto or partition wall. And, since the distance over which the projectile changes from lethal to non-lethal particles is pre-designed into the projectile, unprotected people beyond the lethal range of the core particles would only receive slight abrasions if any injury at all.

Since there is the potential of a point of third impact within the lethal zone, the energy must dissipate rapidly subsequent to the second impact such that the particles become non-lethal and that there can be no third lethal impact point at a point distant from the last impact zone.

The operation of the projectile of the present invention is unlike prior technology. As for example, in the case of the original Glasser bullet design, that has a plurality of round particles in a metal jacket, when the bullet hits it bursts immediately into non-lethal particles and there is no secondary lethal zone. The looser the core of particles the greater the dispersion. In the latest Glasser design the core particles are typically swaged to form somewhat solidified slug that can penetrate multiple layers of glass or partition walls and will only break apart into non-lethal particles after impact with viscous material.

Due to the size of the disclosed projectile, a heavy recoil would be produced using a low burn rate powder to produce a high velocity projectile. Since tests have provided no advantages to using a supersonic velocity, disclosed projectile preferably uses a high burn rate powder that produces subsonic velocity. This lower speed dramatically reduces the recoil while increasing the stability of the projectile in flight.

FIG. 1 is an illustration of a projectile, indicated generally as 100. The overall structure, as for example the gas seal, the wad for absorbing the impact of the firing of the projectile and a core of particles is generally in accordance with the designs and concepts of the prior art. However, the core material containment area, or core material containment member, 102, the actuator 106 and the core particles 120, and the interaction between the various parts are unique to the present invention.

Although all of the embodiments herein are illustrated with an absorption zone, the inclusion of this feature is not critical to the invention. The absorption zone reduces the amount of recoil; however, it does not affect the functioning of the disclosed projectile.

The core material containment area, or containment member, 102 contains the mass of core particles 120 which are contained within the core material containment area 102 by folding over the upper end 104 of the core material containment area 102 to lock the actuator 106 in place. The size of the particles contributes to the effectiveness of the disclosed projectile. The use of fine particles is essential to change a secondary impact from lethal to non-lethal in a short distance.

The core material containment area of the disclosed projectile must be of such material as to have some expansion capabilities, however to great an expansion and the release is uncontrolled. Material too elastic or soft adheres to the gun barrel during the heat and pressure of firing, too rigid or hard a material will tend to burst on tear upon impact. The preferred material is a low density polyethylene, low blow mold grade, or a material having equal performance.

In the embodiment of FIG. 1, the base 124 provides the gas seal and is exposed to about 8000 psi gas pressure upon firing. The absorption zone 126 must be able to withstand the compression of firing and return to its expanded position. The core material containment area 102 must be of a material and design to affect a controlled peel back. It is therefore critical that the material used must meet the foregoing three very different responses in order for the disclosed projectile to perform as described.

The individual, fine particles do not have penetration power as individual particles and are rapidly slowed down by air resistance. To prevent the core particles from possibly compressing into a unified mass that would resist separation upon impact, an absorption zone is used to absorb the initial force of the gun power.

Maintaining the projectile as an integrated or lethal projectile of expanded diameter is achieved through the use of an actuator. The actuator also serves to dam up the particles and keep them confined within the core material containment area. The actuator is preferable a thumb-tack like structure that keeps the individual particles from immediately spreading directly after an initial impact and becoming ineffective with respect to being able to render a terrorist incapacitated. The actuator works in conjunction with the core material containment area to produce the three stage transition from a slug, to a wide diameter blunt trauma producing object and then to non-lethal individual particles.

Figure 21:
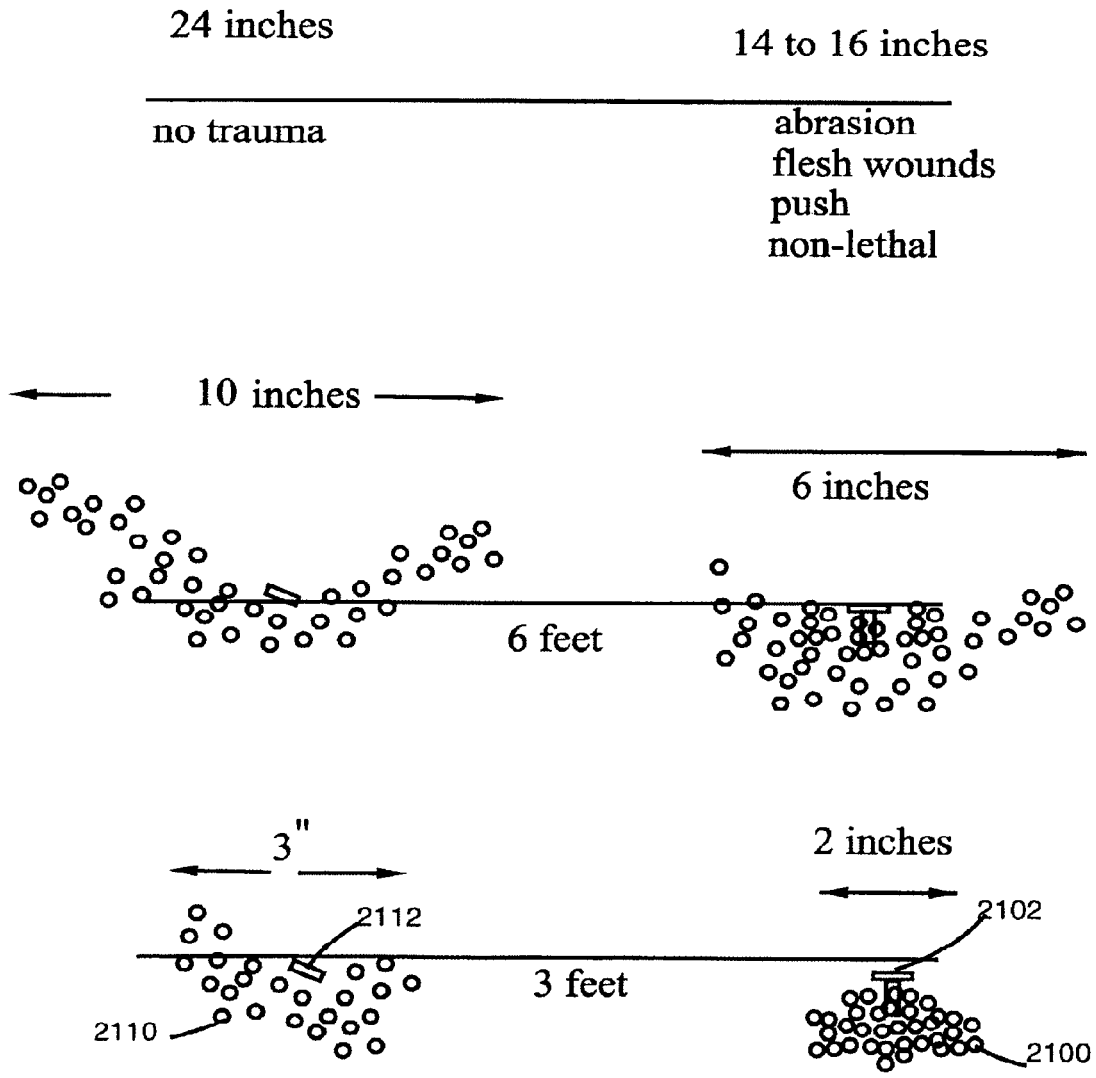
FIG. 21 is a graph comparing the core particle spread using an actuator having a stem to an actuator without a stem.

In the embodiment of FIG. 1, the actuator 106 does not contain a stem which, in some uses where controlling the lethal range is not critical, is advantageous. In most applications, however, the stem provides necessary stability to the actuator. This is illustrated in FIG. 21, the core particles 2100 follow behind the actuator 2102 when the stem is present to provide a stable flight. When an actuator 2112 without a stem is used, the core particles 2110 expand outwardly as the actuator 2112 tips.

After an initial impact, the actuator maintains the particles as a lethal body of increased diameter but still traveling as an integrated body over the predetermined distance of the secondary zone. If the particles spread randomly, or too quickly, impact can be that of hundreds or thousands of minute, non-lethal particles thereby negating the desired trauma effect of the secondary impact zone. Through the use of controlled expansion, the particles impact over a confined area, comparable to that of a very large caliber projectile. The term "very large caliber projectile" is intended to indicate that the effective diameter of the projectile is increased by a factor of at least two and preferably, at least four. Since surface area of a circle increases with the square of the radius, the doubling of the diameter or caliber increases the impact area four fold.

When the pressure wave dissipates, at approximately four to five feet from core particle release, the motion of the actuator 106 is slowed by air resistance, and the particles start to disperse around the actuator. Radial dissipation of energy is the net result. The lethal zone is thus reduced from up to 300 feet, for conventional ammunition, to about three (3) feet in the disclosed design. It is possible to shoot through a wall, door, metal sheet, etc, with the lethal force carrying over to immediately downstream of the initial penetration for roughly three feet.

In embodiments that use particles, they must be discrete particles 120 such that the mass fragments into individual minute particles. Because of the versatility of the disclosed projectile, the size of the core particles is dependent upon the end use. In several of the embodiments disclosed herein, the core particles have a lethal range of less than about ten (10) feet. Because of this short range, the particle size is preferably in the range from about 0.01 inch to about 0.13 inch and most preferably, in the range of from about 0.02 inch to about 0.05 inch. The small size and mass of the individual particles causes them to have a short flight path when exposed to air resistance.

To provide the controlled lethal range described herein, the core particles must be spheres, remaining separate from one another. The use of flake power rather than spherical core particles causes the interior particles to swage together under the pressure of the impact, creating a solid mass that penetrates and proceeds down range from an initial impact, similar to a slug.

To control the lethal range, the particle size, along with actuator angle adjustments can be manipulated to satisfy mission specific needs. By increasing or decreasing the angle, or radius, by 5 to 10 degrees, or increasing the decreasing the overall width or thickness of the angle or radius will slow or accelerate the expansion process in increments of one millisecond or less. For example, to increase the lethal range to about thirty (30) feet, the size of the particles would be increased to about 0.13, along with a reduction or elimination of the angle of the actuator cone.

Figure 2:
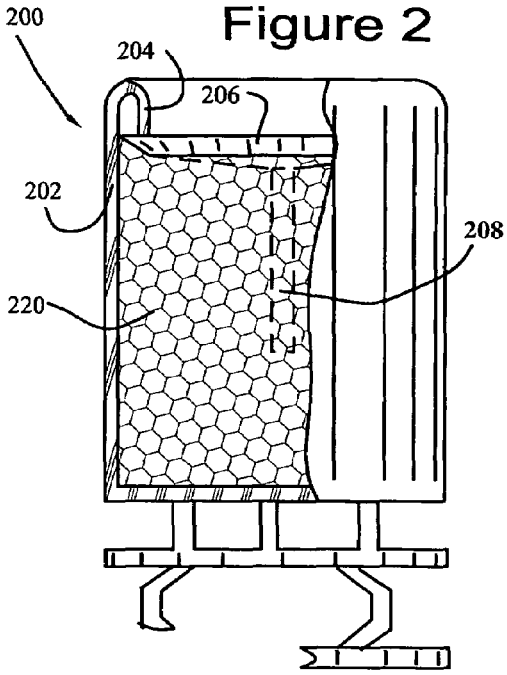
FIG. 2 is a side elevation view, partly in section, of another embodiment of a projectile in accordance with the present invention.
Figure 3:
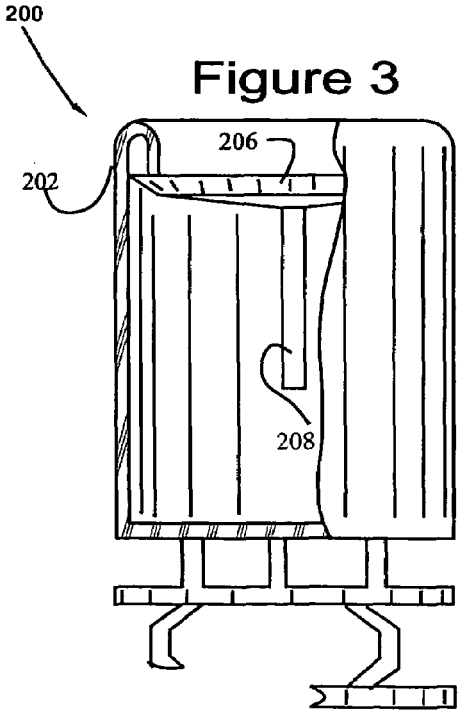
FIG. 3 a side elevation view, partly in section, of the projectile of FIG. 2, shown without the core particles.

FIG. 2 illustrates an alternate embodiment in which the projectile 200 incorporates an actuator 206 that has a thumb tack like shape. The projectile 200 is otherwise essentially the same as in the prior embodiment. The core material containment area 202 is filled with thousands of discrete particles 220 which are maintained in place by the actuator 206, which in turn is maintained in place by the folded over end 204 of the core material containment area 202. In FIG. 3 the projectile 200 is illustrated without the core particles 220 and the stem 208 of the actuator 206, is thus visible.

It is preferable in all embodiments that the end of the actuator be pointed. Although this is not a necessity for performance, it makes the insertion of the actuator into the core material containment area filled with core particles easier. The length of the actuator stem must be about ⅔ of the length of the core material containment area. Since the core material helps maintain the stability of the actuator during post impact flight, at about the ⅓ depth of the containment area there is too little contact with the core particles and the actuator becomes unstable. At a length substantially greater than ⅔ the depth of the containment area, the stem will contact the core material containment area base during the compression upon impact. Even if the stem does not punch a hole in the base of the core material containment area, the impact will throw the actuator out of alignment during flight.

Figure 4:
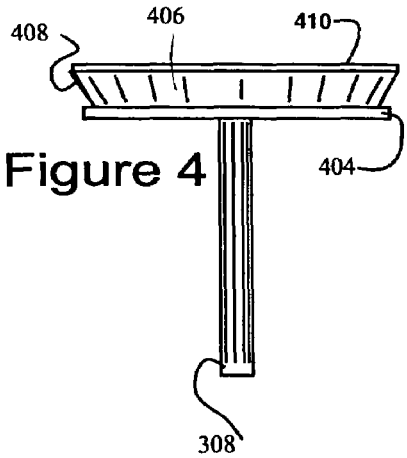
FIG. 4 is a side view of an actuator of the present invention.

An alternate embodiment of an actuator 406 is shown in the enlarged view of FIG. 4. The actuator 406 has a circular flange 404 that locks into the circular channel 504 in the upper end of the projectile 500 core material containment area 502, as illustrated in FIG. 5. The tapered side 408 of the actuator 406 forms a frusta-conical shape that is based on the circular flange 404. The open end of the core material containment area 502 has a tapered top wall 506 that is configured to match the tapered side 408 of the actuator 406. It can be seen in this Figure how the tapered side 408 of the frustro-conical section mated against the tapered wall 506 of the core material containment area 502. Similarly, the circular flange 404 of the actuator 406 is shown locked into the circular channel 504. The projectile 500 is illustrated fully assembled in FIG. 7 wherein the core particles 520 have been sealed within the core material containment area 502 by the actuator 406. The actuator 406 has an integral cap, or flange, 410 that has a diameter equal to that of the core material containment area 502 thereby causing the cap, or flange, 410 to rest on the rim of the cylindrical portion of the open end of the core material containment area 502. This overlap serves to prevent the actuator 406 from angling or shifting during insertion. The cap 410 further prevents the actuator 406 from sinking into the core material containment area 502 and bringing the stem 408 beyond the functional depth.

In FIG. 6 the actuator 420 is illustrated placed within the core material containment area 502 of the projectile 500. The actuator 420 is, as the actuator illustrated in FIG. 4, is designed to mate the tapered top wall 506 and has the circular flange 422 that interlocks with the circular channel 504. The actuator 420 however, does not have the cap 410 of the prior embodiment.

Figure 20:
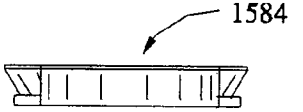
FIG. 20 is a side view of the outer ring resulting from the controlled failure of FIG. 19.
Figure 19:
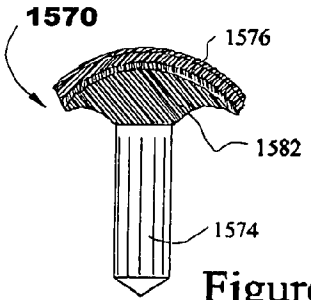
FIG. 19 is a side view illustrating the controlled failure of the actuator of FIG. 16 or 17.

The projectile must produce essentially the same results when passing through steel plate, a car door, a car windshield or a residential interior wall or exterior wall. It has been found that when the actuator impacts a very rigid surface, such as a substantial gage metal plate, the actuator head 1576 will, as illustrated in FIGS. 17, 19-20, enter into a controlled failure, curving back or cupping, upon penetration of the metal. In this manner, the core particles are maintained in a dense cluster and provide greater penetration power than if permitted to disperse laterally. At the moment of penetration between the forward momentum of the core particles pushing forward against the underside of the actuator and the resistance of the material being penetrated, the actuator 1570 curves. As the core particles continue to apply pressure to the inside curvature 1582 of the actuator 1570 and the material being penetrated applies a counter force against the outside curvature 1584 of the actuator 1570, a shearing effect occurs. This affect shears off a ring of plastic 1584 from the outside edge of the actuator 1570 as the rest of the actuator 1570 (FIG. 19) and core particles punch through the material. This is known as a controlled failure because the reduction in the diameter of the face of the actuator 1570 makes penetration easier. Enough of the actuator head 1576, must remains intact so that, aided by the cupping action of the interior angle, the proper spread of core particles into the second and third phase of their flight is facilitated. To achieve this, the actuators are preferably manufactured from a high-density polyethylene, or its equivalent. The material must have a combination of rigidity and toughness to punch through residential type partitions, walls, doors, car windshields and bone without breaking or tearing, yet be flexible enough to enter into controlled failure upon impact with a dense obstacle. The use of an extremely hard material, such as polycarbonate, prevents the actuator from entering into the controlled failure illustrated. As illustrated in FIGS. 22-24, using material that is too soft for the actuator face 1620, or a stem 1626 that is too narrow, enables the stem 1626 and particle to punch through the actuator face 1620, leaving a large, free floating ring 1624.

The penetration power required to pass through sheet rock, that is, a residential interior wall, for example, is less than that required to penetrate the metal plate and the actuator would not deform as in the case of penetration through the metal plate.

The initial transformation of a unitary slug to a lethal projectile of increasing diameter is achieved by rapidly separating the plurality of lethal particles from the core material containment area within which they are contained. If the separation step from the core material containment area is too slow, the particles will spread too slowly and will continue to function as small diameter penetrating projectile, continuing to be lethal over an extended distance. If the expansion is too rapid, the particles lose their incapacitating force too rapidly, eliminating the capability to incapacitate a terrorist standing behind a wall or protected by a car windshield.

To control the transformation the core material containment area peels back and drops away from the particles at a predetermined controlled rate, thus producing a predetermined controlled rate of expansion of the path that the particles follow subsequent to the initial impact of the projectile with an object. The controlled separation of the particles from the core material containment area can be achieved by peeling the core material containment area back upon itself as a result of the contact of the core material containment area with an object having a predetermined density. To achieve this, the controlled peel back rate of the core material containment area must be controlled to release the particles within, preferably, about from 0.0005 to 0.001 seconds as determined by velocity. This would occur upon penetration of a typical residential partition wall, wooden wall or car windshield.

By way of further contrast with the prior art projectiles, in the present invention, the core material containment area travels with the contained core materials until initial impact, peeling back upon initial impact to free the core particles. The amount of resistance necessary for the core material containment area to peel back is very low. Although automobile, safety glass or gypsum board will produce peel back, single pane window glass will not produce peel back. A of heavy corrugated cardboard, a sheet metal panel, a plastic container filled with water, flesh and body organs, are all within the category of materials that will produce the peel back effect. A sheet of paper is typically insufficient to produce the peel back of the core material containment area.

Upon peel back all core particles leave as a single mass and continue their momentum for some distance. For the first predetermined distance, for example two to three feet, the core particles have a lethal, single body effect. The core is continually expanding and after the first predetermined distance, about 3 to 6 feet using the above example, the lethal effect of the core decreases substantially. Up to about a four inch diameter the core particles produce an impact comparable to that of a single slug. A ten inch diameter for the zone of the core particles produces thousands of individual particle impacts and consequently is far less lethal.

Figure 8:
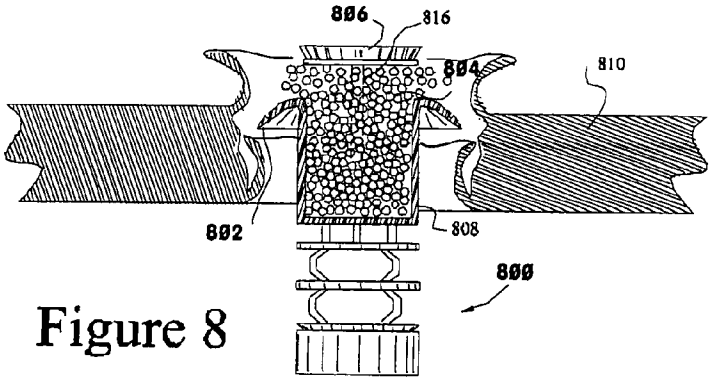
FIG. 8 is a side elevation view, partly in section, of the disclosed projectile, shown after an impact with a target, and showing the initial peel back of the core material containment area.

FIG. 8 shows a projectile 800 penetrating a shielding target 810, as for example a car window, a door or even a relatively viscous mass. The core material containment area 808 begins to peel back and the core particles 804 begin to become free of the containment by the core material containment area. The core particles 804 and the actuator 806 are, as the core material containment area open end 802 is peeled back, released as a core unit from their containment within the core material containment area 808. If the core material containment area peels back progressively, the core particles are released progressively. As noted above, the controlled peel back is critical as if the core material containment area immediately disintegrates, the core material will disperse in an uncontrolled manner and immediately lose the capacity to be lethal.

Figure 9:
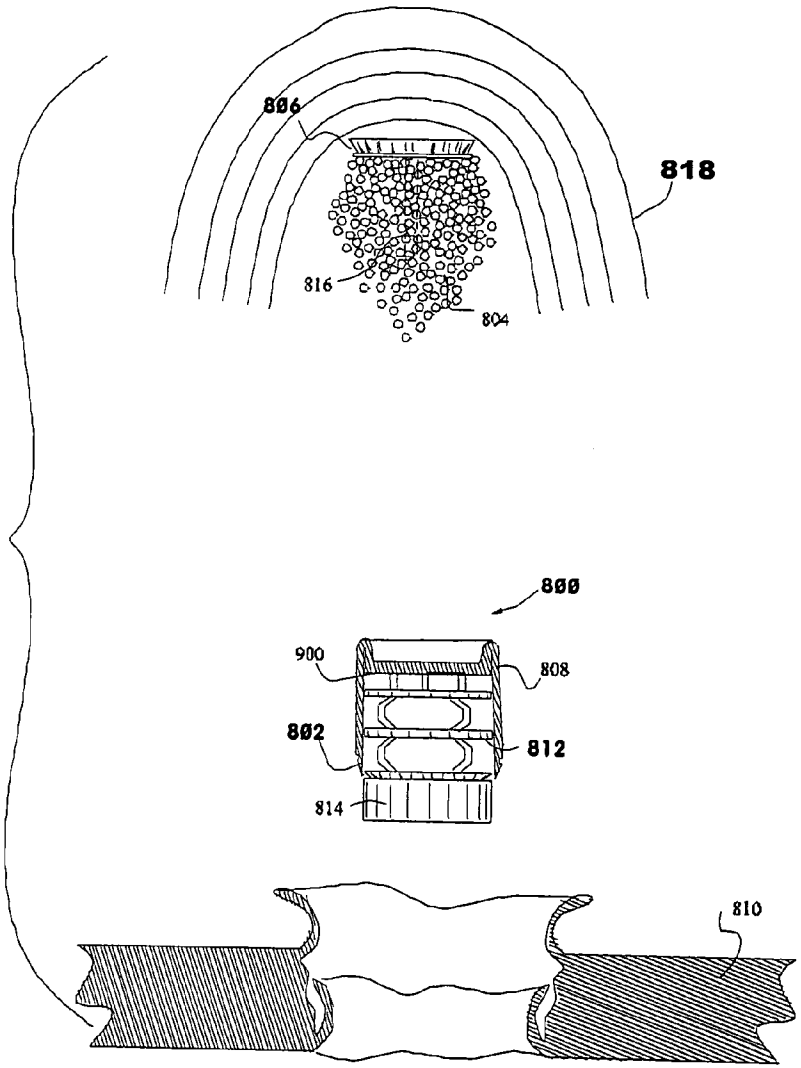
FIG. 9 is a side elevation view, partly in section, of the embodiment of FIG. 8, showing the core material containment area fully peeled back, the core particles and actuator separated from the core material containment area, and the actuator preceded by a pressure wave.

FIG. 9 shows the projectile 800 leaving the shielding target 810 with the core material containment area upper end 802 peeled back upon the crush zone 812. The peeled back section of the core material containment area 808 can be peeled back to the point where the upper most edge 802 extends all the way to the projectile end 814, folding the projectile 800 fully upon itself. The peel back must approximate the rate of travel of the core particles, (projectile velocity) in order to obtain the controlled core particles release illustrated in FIG. 9. With a controlled release, the particles 804 remain clustered and continue to function as a unitary mass, with the exception of a slightly greater diameter than when contained within the core material containment area 808 and of the actuator 806. The core particles 804 lethal mass has a slightly greater diameter than the diameter of the actuator 806, but still are substantially within a unitary grouping.

When passing through a solid or viscous object, the core material containment area 808 peels away and actuator 806 and core particles 804 continue on a forward trajectory along a radial dispersion path. The orientation of the actuator 806 is maintained consistent due to the interaction between the core particles 804 and the stem 816. The stem 816 cannot deviate substantially from the initial path, since the core particles 804 surround the stem 816 and restrict the movement of the stem 816 other than along a path along the stem's axis. As the core particles 804 disperse radially, and start losing their lethal force, the interaction between the particles 804 and the stem 816 continues to lessen and the actuator 806 will eventually tilt and/or tumble with the particles 804 dispersing. Thus the core particles initially impact as a cohesive, unitary body and rapidly disperse radially to the point where they are non-lethal individual particles.

Figure 13:
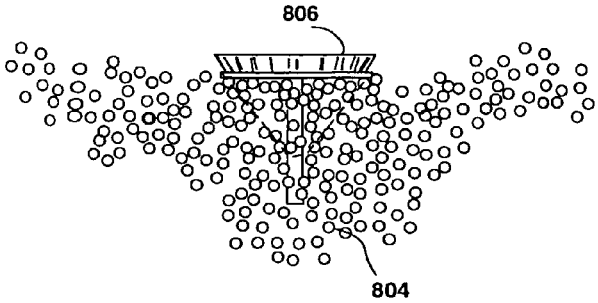
FIG. 13 illustrates a latter stage in which the pressure wave has subsided and the core particles are dispersing radially and in advance of the actuator.

It is the pressure wave created by the projectile's momentum that maintains the core particles 804 within the precise formation behind the actuator 806. As expansion occurs the pressure wave dissipates and becomes insufficient to make a path for the actuator 806. That is, when the air resistance dampens the forward movement of the actuator 806, as illustrated in FIG. 13, the particles begin to radially disperse. When the projectile does not contact a secondary target, the particles 804 will disperse due to the air resistance preventing the particles from traveling a substantial distance. Once the particles have been slowed due to air resistance, as illustrated in FIG. 13, the particles act as non-lethal individual particles. This dispersal must occur within a zone that is from about seven feet to within about ten feet from the point of initial impact.

As the core material containment area 808 folds back, the actuator 806, followed by the core particles 804, is released and continues the forward momentum. The mass of the core particles 804 begins to elongate and spread, but remains behind the actuator 806.

For the first three to four feet of travel after core particle release, a pressure wave 818 precedes the actuator 806 and mass of core particles 804 and produces a low pressure area around the actuator and mass of core particles. Thus the actuator 806 encounters little wind resistance, even though it presents a broad, flat surface.

In the first few feet of flight the blunt design of the actuator 806 results in its being dragged along behind the pressure wave 818. Since the individual particles have a low resistance to air, on their own they would neither produce this pressure wave effect, nor be pulled by the vacuum zone produced by the pressure wave. Thus, the blunt design of the actuator 806 creates the pressure wave 818, producing a vacuum zone, which in turn further lessens the air resistance for the particles. Additionally, the cone affect of the pressure wave 818 helps to maintain the particles 804 in the lethal mass behind the actuator 806. Usually within seven to ten feet from release from the core material containment area the pressure wave dissipates, and the actuator's blunt shape causes it to offer high resistance and slow down and/or deviate from its straight-line trajectory. The particles at that point disperse radially to the point where they do not impact as a unitary mass, but rather impact as non-lethal individual particles.

The expansion of the core particles starts immediately upon peeling away of the core material containment area, however, to only a limited extent. The pressure wave leads, followed by the actuator, and core particles. The core particles tend to stay in a cohesive group initially, preferably for about three to six feet. The projectile design is such that the pressure wave dissipates rapidly and after travel through the initial zone in which the cohesive mass of particles form a unitary lethal mass, the particles are not tightly packed around the centering stem of the actuator and the actuator no longer travels along a straight trajectory.

Figure 10:
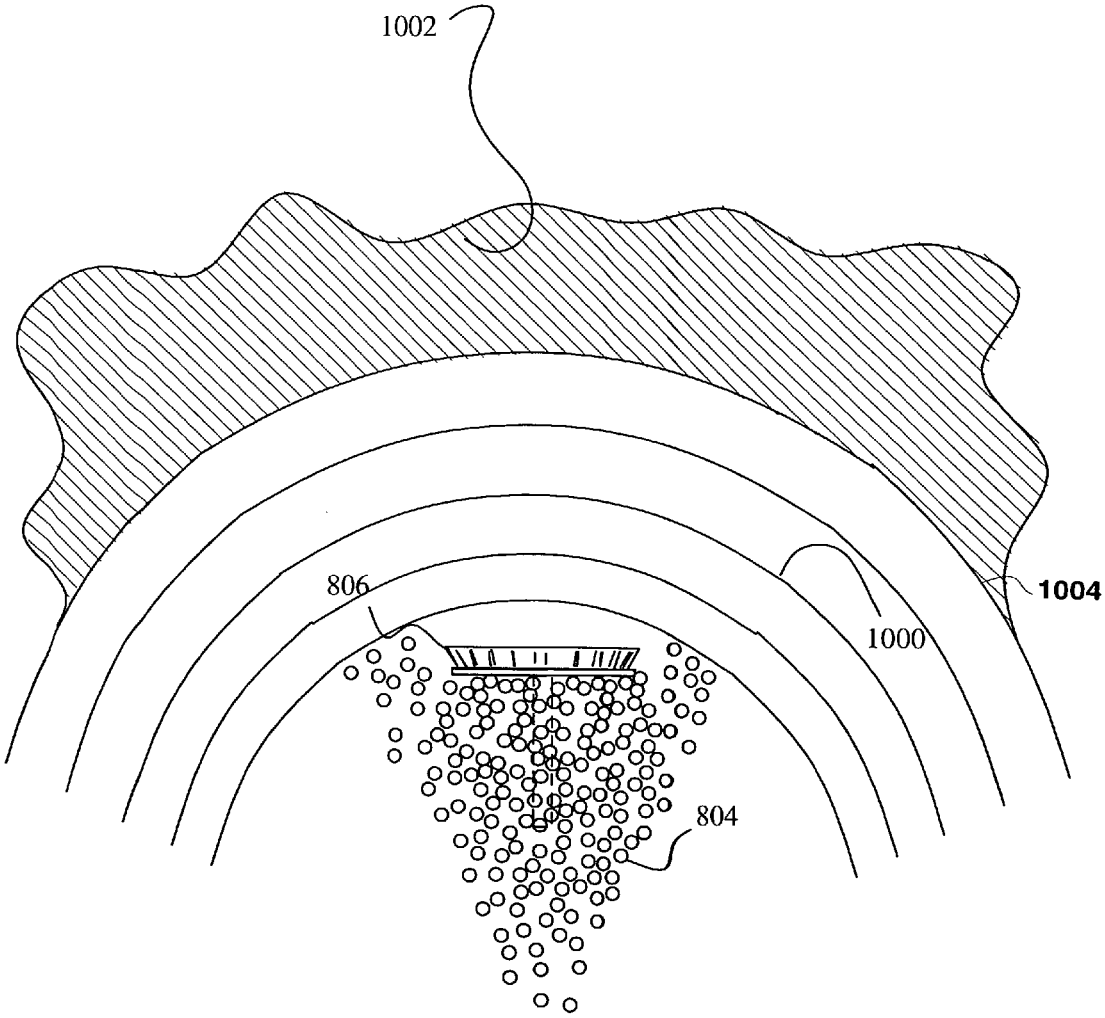
FIG. 10 is a side view of the core particles and actuator of FIG. 9 impacting a secondary region of a viscous target.

This pressure wave effect is dramatically amplified within highly viscous material such as the internal organs of the human body, and becomes a highly destructive force in and of itself. FIG. 10 illustrates the effect of the disclosed projectile when the initial and secondary impact area is a body. As seen herein, the pellets 804 are preceded by a broad, essentially flat pressure wave represented by lines 1000 and thus impact the secondary target 1002 of an organ, over a wide area. The pressure wave 1000 impacts the surface 1004 of the secondary target 1002; driving the surface 1004 away from the advancing actuator 806 and mass of core particles 804.

The force of the pressure wave 1000 can cause a severe trauma over a very large area and can virtually liquefy a body organ. Thus, the effective impact area is substantially larger than the area of the actuator 806 or the mass of core particles 804.

The point of initial impact determines the damage done to a body upon impact by the actuator and core particles. If the initial impact is through a car window or partition wall and the body is hit, within about three (3) feet from the initial impact, the actuator and particles will penetrate the skin and organs nearer the surface and deliver a heavy blunt trauma impact. If, however, the initial impact is through a wall and the body is ten (10) feet beyond the point of exit, the damage will be minimal, if any.

When the initial impact is a body, the peeling back of the core material containment area and release of the core particles takes place within the flesh and the actuator and core particles go on to penetrate the internal organs. Because of the density of the body, the core particles are slowed much faster, therefore remaining within the body. This prevents any accidental injuries due to a bullet passing through the body of initial impact and hitting a second person. Additionally, because of the viscosity of the internal organs, the pressure wave will do extensive damage to organs as it moves through the body, to be stopped at surface of the impacted cavity opposite the point of entry by the surrounding skin and flesh. The elasticity and strength of surface muscle, bone and skin structure, combined with the slowing of the pressure wave, causes the pressure wave to recoil back toward the point of entry.

Figure 11:
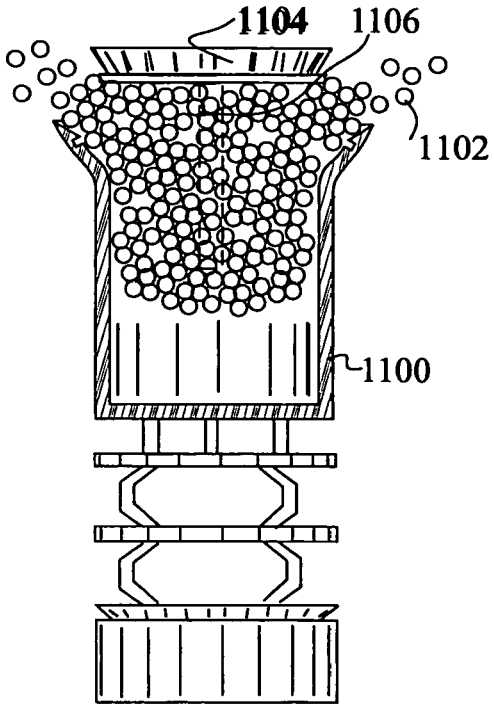
FIG. 11 illustrates an initial stage in which peel back stage is too slow and the core particle mass begin to exit the core material containment area prior to the actuator.
Figure 12:
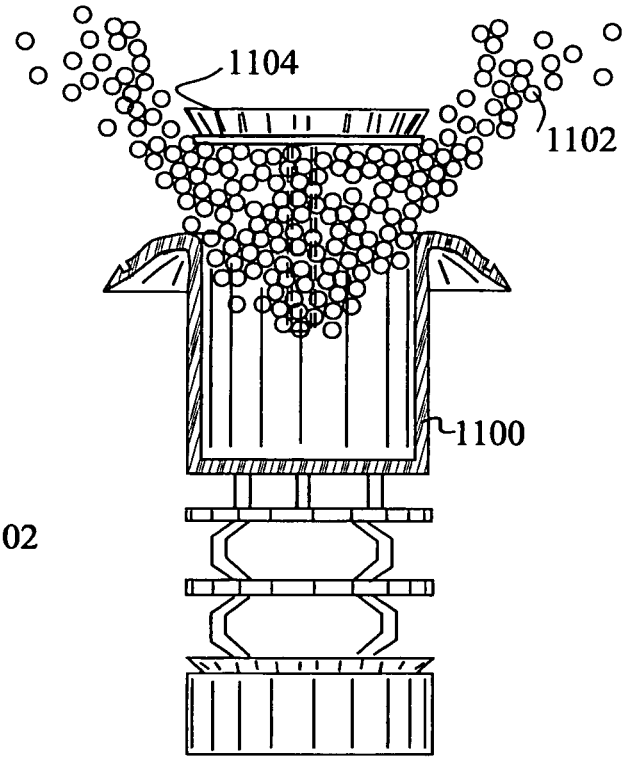
FIG. 12 illustrates a subsequent stage in which the core particle mass of FIG. 11 have begun to spread around, and ahead of, the actuator.

As stated heretofore, the speed of the peel back is critical. FIGS. 11 and 12 show what happens to the core particles 1102 when the peel back of the core material containment area 1100 is partial, or too slow, thereby preventing simultaneous release of the core particles 1102. When the core material containment area 1100 passes through the initial impact area and remains in the configuration illustrated in FIG. 11, a portion of the core particles 1102 will remain within the core material containment area 1100. If the core material containment area 1100 continues to slowly peel back, moving into the configuration of FIG. 12, the particles 1102 start to exit between the actuator 1104 and the core material containment area 1100, since the actuator 1104 is being slowed by the stem 1106, still retained within the particles 1102 remaining within the core material containment area 1100. This causes the particles 1102 to immediately start dispersing, spreading laterally, while degrading from a unitary mass to independently acting particles. The partial or slow peeling of the core material containment area results in a lengthening of the secondary zone and increased instability of the actuator 1104.

The core particles within inches of leaving the core material containment area 1100 reach the final broad radial dispersion illustrated in FIG. 13. In a slow, or uncontrolled, peel back, the distance between initial impact and the final broad radial dispersion is undeterminable due to the unpredictability of the separation. This can also occur if the core material containment area tears or splits due to structural irregularities or poor material selection, as the particles will disperse through the tears in the core material containment area in an uncontrolled manner, and will no longer act as a unitary mass.

It should be noted, however, that planned splitting of the core material containment area, due to predetermined scoring of the core material containment area materials, will enable controlled dispersal of the inter particles. In this embodiment, however, the scoring is done at a depth that will enable the split to occur in a timed manner to release the core particles in a controlled manner when a faster release is required such as in door breeching scenarios. This includes, but is not limited to, shooting the locks or hinges off doors or bomb disposal as a disruptor round.

Figure 14:
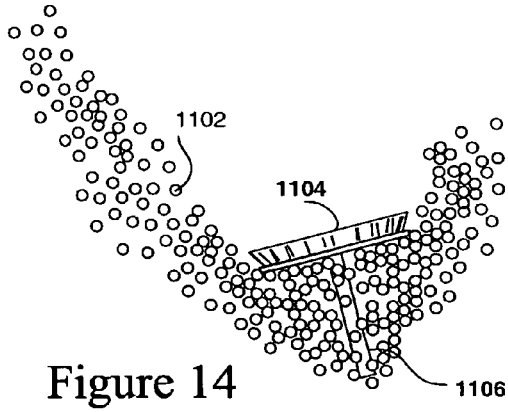
FIG. 14 illustrates a side view of the core particle dispersal when the core material containment area peel back is too slow

When the peel back is too slow, the particles reach the dispersal stage illustrated in FIG. 14, far more rapidly than when the peel back is at the speeds taught herein. In the event of a tearing of the core material containment area, the dispersal would be similar but would be in an inefficient and irregularly shaped star burst form, when viewed three dimensionally.

Although the broad radial dispersal of FIG. 13 is the desired end point, when properly constructed the projectile as disclosed herein, does not reach that point until seven (7) to ten (10) feet after leaving the core material containment area. The slow core material containment area peeling illustrated in FIGS. 11 and 12 would make the projectile ineffective for a secondary impact if it had to pass through an initial shield, such an auto windshield or residential partition wall.

EXAMPLE I

The target was a residential type interior partition wall with a single layer of one half inch thick (½") gypsum board on each side of a standard stud wall. The projectile was a shell having a mass of 7000 small pellets as core particles confined within a core material containment area. The leading, open end of the core material containment area was closed by a thumbtack like actuator. During the penetration of the wall the core material containment area peeled back, releasing the actuator and the mass of particles. For a distance of about three feet, the mass of particles traveled in a confined zone, as an expanding but lethal mass of particles. The mass of core particles had a center core of dense packed particles with a spreading fringe of individual particles. At the end of three (3) feet, the particles had a radial dispersion diameter of about two inches. The pressure wave then dissipated to the point where drag set in and at a distance of about seven (7) to about ten (10) feet, the intermediate zone of the pellets expanded to form a large diameter zone of less lethal individual acting particles. Impact with the particles against a target just beyond ten (10) feet from the point of initial impact, could cause abrasion but would not be lethal.

EXAMPLE II

The targets were seventeen (17) to eighteen (18) pound whole pork shoulders. A one-inch thick plywood sheet barrier was placed 36 inches behind the shoulder directly within the line of fire. The aim point was the heavy muscled area just over the shoulder joint itself which would create a projectile path from the outside of the shoulder toward where the shoulder would attach to the animal.

Using several different types of conventional ammunition, the projectiles passed through each pork shoulder and on through the plywood barrier.

In the test firing using the disclosed projectile the one inch plywood sheet barrier was replaced with a ½ inch thick piece of sheetrock. It was determined that if the projectile, or any part of the pork shoulder penetrated the sheetrock, that configuration of the projectile would be considered a failure.

Using the projectile as disclosed herein, the shoulder joint was cleanly separated and blew through a large hole in the back of the shoulder. The paper on the surface of the sheetrock was slightly cut from either the projectile casing or a bone fragment but was otherwise undamaged. Neither the joint bone nor cartilage material was marred by the projectile or core particles. Forensic dissection of the shoulder later reveled that the vast majority of core particles had expended their energy inside the shoulder and stopped before reaching the joint itself. The indication was that the shoulder joint had been cleaved from the rest of the bone structure by a pressure wave that had been built up inside the pork shoulder and preceded the expanding projectile through the impact area.

Under normal circumstances, neither the casing nor the bone would have passed through the body due to the viscosity of a living body. Since the pork shoulder consists of dry tissue, and the viscosity is reduced, the dry tissue and bone "bunched" behind the actuator, barely exiting at the back of the shoulder Surprisingly, the actuator is almost perfect after impacting the eight-inch thick pork shoulder. The pressure wave blows out an area about four times that of the original projectile diameter.

EXAMPLE III

For example, in the case of a steel drum filled with water and having a 10 inch diameter and 18 inch high, of a fairly high gauge steel, the impact of the projectile of the present invention rips out the front but does not effect the back wall. There is a rebound of the pressure wave, that is, a water hammer effect.

The rebound hydraulic shock can be four times the impact of the initial pressure wave. The present invention projectile, unlike prior art projectiles, produced large bulges at the side and top of the steel drum, but no exit hole. The shock wave does massive damage, and the blunter the nose and the faster the expansion, the greater the shock wave.

A penetrating bullet takes the shock wave with it through the exit opening. A full metal jacket projectile has a very high penetration force and will pass cleanly the same type of container, creating minimal bulging and only a small entrance and exit hole. Thus, the diameter of the trauma zone is very small. In the case of the penetration of a heart it may take an extended period of time for the target to succumb to the wound, due to bleeding. The projectile of the present invention, however, can produce an actual projectile expansion of four (4) to five (5) inches in diameter and a highly destructive ten inch, or larger, diameter shock wave. Since the projectile does not exit the body there is a shock wave rebound and a huge trauma zone.

EXAMPLE IV

In order to determine the lethal range of the core particles after encountering an initial impact area, two layers of denim were placed three (3) inches in front a sheet of plywood. The disclosed projectile was shot through an impact media ten (10) feet in front of the denim and plywood backstop. If the core particles caused any substantial damage to the plywood, or deeply embedded into the plywood, the test was considered unsuccessful. When the core particles were slightly embedded into the plywood and could be easily brushed off, the test was considered successful.

The above tests would also be applicable to different distances and the distance adjustments would be obvious to those skilled in the art when read in conjunction with this disclosure.

FIG. 15 illustrates an embodiment of the core material containment member 1500, in which the core material containment area wall 1508 is gradually tapered. The wall 1508 thickness is greater at the base edge than at the leading edge or open end. This design is used to precisely control the rate of peel back of the core material containment area 1508. By increasing the overall thickness the core material containment area 1508, the controlled peel back rate will be slowed and, conversely, narrowing the thickness will increase the rate of peel back. The taper enables the peel back to start quickly while the thicker bottom maintains the necessary rigidity. If the core material containment member has a uniform thickness, the initialization of the peel back can be too slow to effectively release the core particles simultaneously, since the controlled peel back rate must be substantially equal to that of the velocity of the projectile in order to provide the controlled release. Generally the controlled peel back takes place within about 0.0005 and 0.001 seconds. Therefore, as the velocity of the projectile is changed, through projectile size, powder type or other customizations, the controlled peel back rate is adjusted accordingly.

Figure 28:
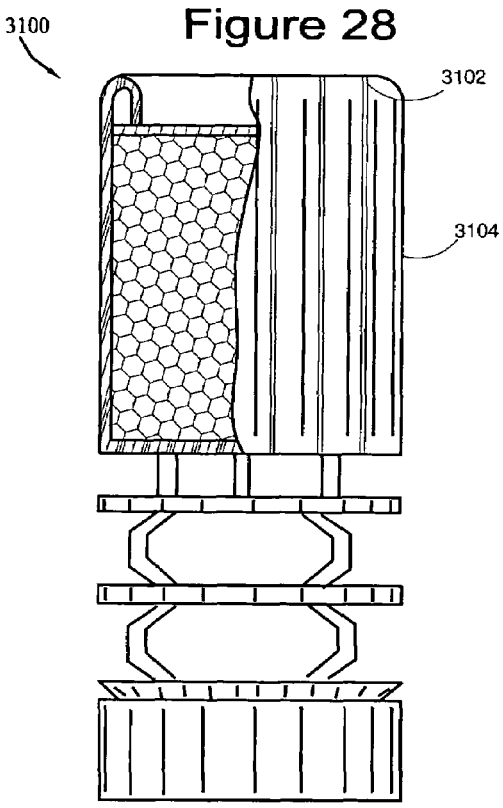
FIG. 28 is a cutaway side view of an alternate embodiment wherein the core material containment area is slit to facilitate a more rapid, but controlled, peel back.

As stated heretofore, another method of controlling the controlled peel back rate is to score the core material containment area as illustrated in FIG. 28. In this embodiment the core material containment area 3104 is scored as peel lines 3102. The number and depth of the score lines directly affects the rate of peel back, however scoring the core material containment area deeper than 50% of the core material containment area thickness over compromises the core material containment area. Although this is not as reliable as tapering the core material containment area, as too many scores or too deep a scoring will cause the projectile to explode upon first impact, there are specific situations is would be of value in door breeching, bomb disruption and other such known to those skilled in the art.

The actuator design can be altered to facilitate the desired controlled expansion of the core material, or pellets. In applications where it is undesirable for the actuator to shear, as described heretofore, an actuator 1500, of FIG. 16, can be used. The actuator 1500 has a conical region 1506 that merges at its apex end with a longitudinal stem 1504, has been found to prevent the actuator lead surface 1502 from shearing away on impact. If the lead surface 1502 shears upon impact, the core particles continue to travel as a unitary mass for an extended period of time, thus extending the secondary lethal zone well beyond the preferred maximum distance of ten feet required in this embodiment. This configuration would be used in embodiments where the secondary lethal zone is extended, in a controlled manner, to meet specific law enforcement needs.

The optimum cone angle to achieve the three (3) to seven (7) foot lethal zone is about 40° to 60° from the centerline and preferably in the range of 55° to 58° from the centerline. The lethal zone can be adjusted by changing the cone angle, controlled peel back rate and core particle size. For example, a 40° angle almost eliminates the lethal secondary zone, as the energy of the core particles dissipates immediately. Having an angle of less than 10° doubles the lethal zone if all other factors are the same. The actuator 506 of FIG. 7 would be an example of an extended lethal zone.

FIG. 17 illustrates an actuator 1570 that has a lesser conical region 1572 than the embodiment of FIG. 16. Although a lesser angle is used for the conical region 1572, the stem 1574 has a wide diameter to facilitate faster expansion. The wide stem also keeps the mass of the core particles away from the actuator mid-point, minimizing the tendency of the core particles to penetrate the center of the actuator head upon impact. Such central penetration can result in a random dispersion of particles.

The actuator 1600 illustrated in FIG. 18 has a conical region 1602 of less than maximum diameter and a narrower stem 1604. Although the narrow stem 1604 is not recommended for applications with a short lethal range, it can be advantageous in specific applications, as will be evident to those skilled in the art.

The spherical core particles can be substituted with fragmented plates that will shred whatever surface they come in contact with. This can be advantageous as it will more effectively penetrate the sheet metal body panels of an automobile, shred the interior, and not exit the other side. The same result is achieved when the spherical core particles are replaced with washer type plates. It should be noted that solid flat plates will not provide the same result. Without the center hole, the flat plates turn on edge and will travel for long distances. The center hole creates aerodynamic instability causing the plates to flip at high rotational speeds decreasing their range of flight and increasing the damage as they rotate. These washer type plates are especially affective in close areas, such as automobiles, where their spinning will create a substantial amount of damage. When using this, or any other embodiment, to penetrate heavy metal such as is found in an armored vehicle, the actuator without a stem would be used and would be manufactured in metal, thereby providing greater weight.

Figure 25:
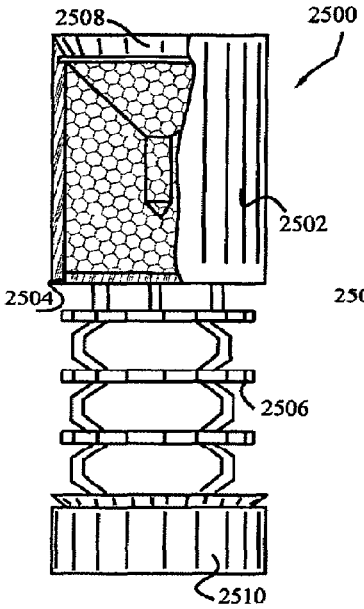
FIG. 25 is a cutaway side view of an alternate projectile embodiment using a sliding core material containment area.
Figure 26:
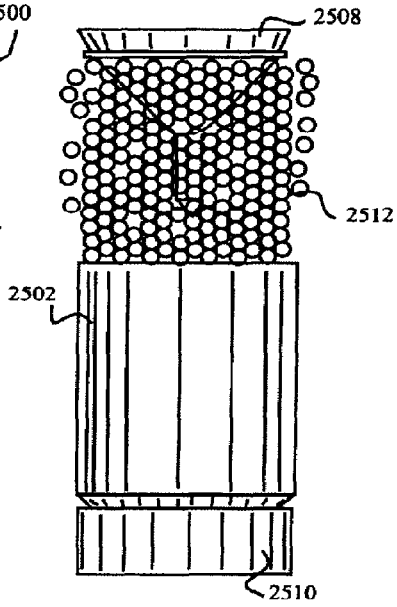
FIG. 26 is a side view of the core material containment area of FIG. 25 with the core material containment area slid into the particle release position.

An alternate to the foregoing peel back method is illustrated in FIGS. 25 and 26 in projectile 2500 wherein the core material containment area side 2502 is scored along the base score line 2504, providing a weakened breaking point. In this embodiment, the wad 2506 has a diameter smaller than that of the core material containment area side 2502 to enable the core material containment area side 2502 to slide over the wad 2506 and rest on the gas seal 2510, as seen in FIG. 26. The score line 2504 fails under pressure and, as it slides back in response to the air pressure, the actuator 2508 and core particles 2512 are released.

Figure 27:
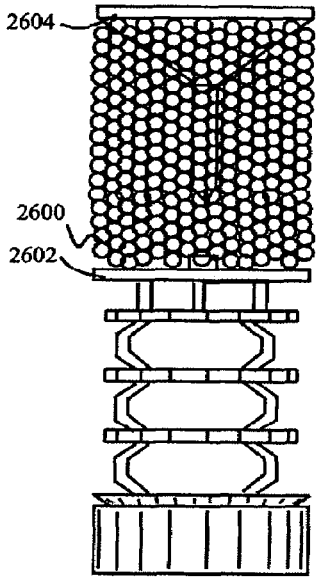
FIG. 27 is a side view of an alternate embodiment using a bonding agent to adhere the core particles.

In FIG. 27 an alternate embodiment uses a bonding agent to maintain the core particles 2600 in a consolidated cylindrical form. The conventional crush section 2602 serves as a base unit while the actuator 2604 serves as a top portion. The actuator 2604 works in the same way as previously described. Upon initial impact the bonding agent holding the core particles in a cohesive form shatters, thereby releasing the core particles 2600 to follow the actuator 2604 as described herein. Alternatively the actuator can be eliminated and the core particles bonded into a cylindrical unit affixed to the crush section. As stated above, upon impact the bonding agent would shatter, releasing the core particles. This embodiment would not have the control of expansion after impact provided by the foregoing embodiments incorporating the actuator; however, in specific applications this embodiment could provide advantages.

Figure 29:
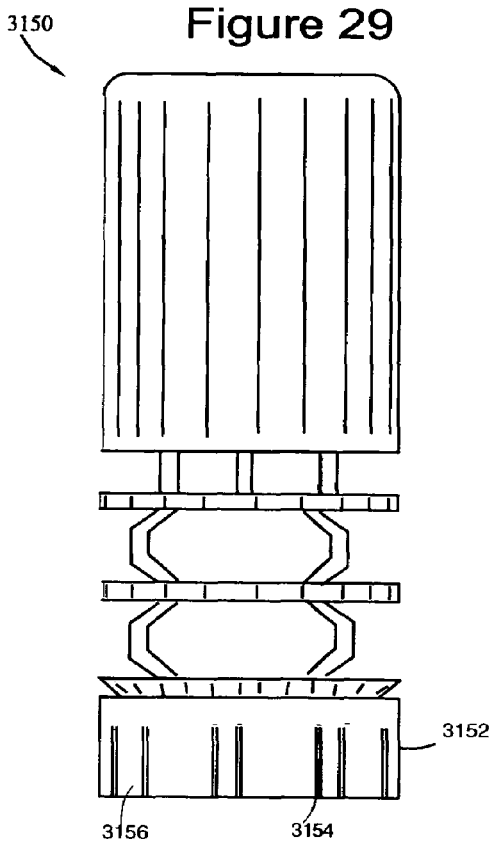
FIG. 29 is a side view of an additional embodiment wherein the gas seal has been cut to form brake segments to slow down the projectile after a predetermined period of time.

In heavily populated urban areas where it is desirable for the projectile to only travel a limited distance, the projectile can be designed to drop out of the lethal range at a predetermined distance. Almost all tactical shooting in urban areas is done at a distance of 50 yards or less and therefore, in many situations it would be desirable for the projectile to lose lethality in under 150 yards. In the projectile 3150 of FIG. 29, the gas seal 3152 has been cut at separator lines 3154. Each pair of separator lines 3154 defines brake segments 3156.

Figure 30:
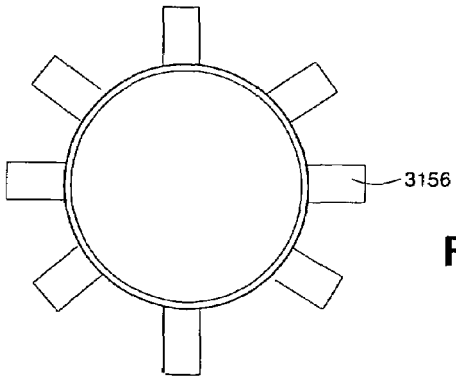
FIG. 30 is a top view of the gas seal of FIG. 29 with the brake segments in an open position.

The brake segments 3156 are deployed by escaping gas as the projectile clears the muzzle of the barrel. At operational velocity the pressure of the slip stream keeps the brakes 3156 compressed just slightly larger than the diameter of the projectile body. As the projectile slows pressure is relieved and the brakes 3156 expand, as illustrated in FIG. 30 into a more open position creating drag and slowing the projectile until it falls out of flight. The time period between initial firing and the opening of the brake segments 3156 can be predetermined by the thickness of the plastic and width of the segment. The travel distance between the opening of the brake segments 3156 and non-lethality can be determined by the number of brake segments 3156 and their size.

When the core particles are silicon carbide, the projectile, using any of the embodiments above, can be used to halt boats by penetrating the engine. The silicone carbide filled projectile performs the same as described heretofore, however rather that lethal particles being released, silicone carbide, or other material having the same properties, is propelled into the engine. When used to stop boats, the round is fired through the engine cowling, which peels back the containment area and releases the core material. The silicon is brought into the engine through the air intake port and is trapped within the engine, abrading the interior until engine failure.

When using pure plastics, or plastic compounds, as the particle material, additional weight must be mixed in to provide the needed weight. This can be accomplished by coating the heavier material with the plastic. The advantage to the use of plastic is that elimination or minimization of lead leaching into the ground from used bullets.

The use of a blow mold grade low density polyethylene has been found to provide a core material containment area material that will allow the core material containment area to peel back completely, without tearing, and at the desired rate. The actuator is preferably formed from high density polyethylene. The use of a very rigid polymer or other material, such as a carboxylate, is not preferred, because of the tendency to be too rigid on impact.

It should be noted that for simplicity in description, the term shot gun shell is used herein as representing the primary application of the ballistic projectile of the present invention. However, the principles also apply to handgun ammunition and other types of ballistic projectiles.

What is claimed is:

1. A projectile comprising an absorption zone, a gas seal, propulsion material, and a core material containment member, said core material containment member having a base, an open end, an interior periphery and an exterior periphery and being a material that will, upon initial contact with a obstacle at a first lethal distance, initialize peeling back upon itself at a predetermined controlled peel-back rate, a lethal mass of core material, said lethal mass of core material being within said core material containment member, and a radial dispersion control actuator, said radial dispersion control actuator being releasably affixed to said core material containment member and having a first surface, a second surface adjacent to a first surface of said lethal mass of material, and a depth between said first surface and said second surface said absorption zone, said gas seal, and said propulsion material, being adjacent to said base of said core material containment member.

2. The projectile of claim 1 further comprising an actuator stem, said actuator stem extending from said second surface of said radial dispersion control actuator into said lethal mass of core material.

3. The projectile of claim 2 wherein said predetermined controlled peel-back rate is such that upon release of said radial dispersion control actuator from said core material containment member, said lethal mass of material surrounds said stem to maintain said radial dispersion control actuator on a direct course.

4. The projectile of claim 1 wherein said predetermined controlled peel back rate is such that said lethal mass of core material is released from said core material containment member and travels behind said radial dispersion control actuator for a predetermined second lethal distance as a lethal mass.

5. The projectile of claim 4 wherein said radial dispersion control actuator is shaped such that upon slowing of said radial dispersion control actuator said lethal mass is dispersed over a third distance, said third distance being a non-lethal distance.

6. The projectile of claim 5 wherein said third non-lethal distance is at about ten feet from said initial impact.

7. The projectile of claim 4 wherein the configuration of said radial dispersion control actuator controls the second lethal distance.

8. The projectile of claim 7 wherein said second lethal distance is from 0 to about five feet from said initial impact.

9. The projectile of claim 1 wherein said radial dispersion control actuator second surface has a periphery less than said interior periphery of said core material containment member.

10. The projectile of claim 9 wherein said radial dispersion control actuator first surface has a periphery equal to said exterior periphery of said core material containment member.

11. The projectile of claim 1 wherein said radial dispersion control actuator is releasably affixed to said open end of said core material containment member by folding the edges of said core material containment member onto said radial dispersion control actuator.

12. The projectile of claim 1 wherein said radial dispersion control actuator is releasably affixed to said open end of said core material containment member by adhesive.

13. The projectile of claim 1, wherein said lethal mass of core material is multiple individual particles.

14. The projectiles of claim 13 wherein said particles are silicon carbide.

15. The projectile of claim 13 wherein said particles are lead.

16. The projectile of claim 13 wherein said particles have a diameter substantially in the range from about 0.02 of an inch to about 0.13 of an inch.

17. The projectile of claim 1 wherein said gas seal is a wad absorption zone.

18. The projectile of claim 1 further comprising a circular flange at said second surface of said radial dispersion control actuator.

19. The projectile of claim 18 further comprising a circular channel in said interior periphery of said open end of said core material containment member, said circular channel being positioned and dimensioned to receive said circular flange and to position said first surface of said radial dispersion control actuator at said open end of said core material containment member.

20. The projectile of claim 1 wherein said interior of said core material containment member and said depth of said radial dispersion control actuator are tapered to enable said radial dispersion control actuator to mate with said core material containment member.

21. The projectile of claim 1 wherein said predetermined controlled peel-back rate to release said core material is between about 0.0005 and 0.001 seconds.

22. The projectile of claim 1 further comprising a score line between said base and the wall of said core material containment member, said score line controlling said peel-back rate.

23. The projectile of claim 1 further comprising core material containment member scores extending from said open end to said base, said core material containment member scores controlling said peel-back rate.

24. The projectile of claim 1 further comprising separator lines in said gas seal, said separator lines forming brake segments, said brake segments initially expanding upon release from a shotgun barrel at a predetermined angle and being forced to a non-expanded position by velocity, said brake returning to said predetermined angle as said projectile slows, thereby further slowing the travel speed of said projectile.

25. The projectile of claim 24 wherein said brake segments control the deceleration of said projectile.

26. The projectile of claim 1 wherein said first surface creates a pressure wave that proceeds said radial dispersion control actuator for a predetermined second lethal distance upon release from said core material containment member.

27. The projectile of claim 1 wherein said core lethal material is multiple plates.

28. The projectile of claim 1 wherein said core lethal material is steel.

* * * * *